US009233738B2

(12) United States Patent
Bruce

(10) Patent No.: US 9,233,738 B2
(45) Date of Patent: Jan. 12, 2016

(54) OFFSHORE MARINE ANCHOR

(71) Applicant: Peter Bruce, Isle of Man (GB)

(72) Inventor: Peter Bruce, Isle of Man (GB)

(73) Assignee: BruPat Limited, Isle of Man ( * ) Notice: Subject to any disclaimer, the term of this patent is extended or adjusted under 35 U.S.C. 154(b) by 0 days.

(21) Appl. No.: 14/350,525

(22) PCT Filed: Sep. 21, 2012

(86) PCT No.: PCT/GB2012/052333
§ 371 (c)(1),
(2) Date: Apr. 8, 2014

(87) PCT Pub. No.: WO2013/054087
PCT Pub. Date: Apr. 18, 2013

(65) Prior Publication Data

US 2014/0261136 A1 Sep. 18, 2014

(30) Foreign Application Priority Data

Oct. 12, 2011 (GB) ..... 1117570.0

(51) Int. Cl.
*B63B 21/32* (2006.01)
*B63B 21/42* (2006.01)
*B63B 21/46* (2006.01)

(52) U.S. Cl.
CPC ..... *B63B 21/42* (2013.01); *B63B 21/46* (2013.01)

(58) Field of Classification Search
USPC ..... 114/301, 304
IPC ..... B63B 21/26,21/46, 21/42
See application file for complete search history.

(56) References Cited

U.S. PATENT DOCUMENTS

| | | | | |
|---|---|---|---|---|
| 5,546,883 | A * | 8/1996 | van den Haak | 114/301 |
| 6,220,198 | B1 * | 4/2001 | Bruce | 114/301 |
| 2011/0100283 | A1 * | 5/2011 | Resch | 114/299 |

FOREIGN PATENT DOCUMENTS

| | | | |
|---|---|---|---|
| EP | 0802111 | A2 | 8/1996 |
| WO | 98/32648 | A1 | 7/1998 |
| WO | 98/36963 | A1 | 8/1998 |
| WO | 2013/054087 | A1 | 4/2013 |

OTHER PUBLICATIONS

International Search Authority, "International Search Report," PCT/GB2012/052333, mailed Jan. 11, 2013.

* cited by examiner

*Primary Examiner* — Stephen Avila
(74) *Attorney, Agent, or Firm* — Benjamin A. Balser; Balser & Grell IP Law

(57) ABSTRACT

A marine anchor is described which has a fluke with a shank pivotably attached thereto wherein the shank is remotely lockable pivotably and subsequently remotely unlockable pivotably with respect to the fluke.

20 Claims, 3 Drawing Sheets

OFFSHORE MARINE ANCHOR

CROSS REFERENCE TO RELATED APPLICATIONS

This application claims priority to PCT application Ser. No. PCT/GB2012/052333 filed on Sep. 21, 2012; and to GB patent application Ser. No. 1117570.0, filed on Oct. 12, 2011, which are incorporated by reference herein.

The present invention relates to a marine anchor and particularly to a drag embedment offshore marine anchor, such as that used on semi-submersible drilling platforms, which is initially pulled horizontally by an anchor line to effect penetration through a surface of a mooring bed.

Typically, a marine anchor comprises an elongate shank attached to a planar fluke having a sharp foremost edge, with a foremost point therein, for promotion of penetrative engagement with a mooring bed soil when pulled horizontally over the surface of the mooring bed by means of an anchor line fastened to the anchor at an attachment point on the shank distal from the fluke. The attachment point lies on a notional straight line, extending from a rear edge of the fluke, which forms a forward-opening acute fluke angle with the plane of the fluke. The fluke angle is usually about 30° to facilitate penetration in firm clay or sandy soils or about 50° to facilitate penetration in soft clay or soft silt soils. The attachment point also lies on a notional straight line, extending from the foremost point of the fluke, which forms a forward-opening acute point angle with the plane of the fluke. The point angle is usually in the range of 60° to 70° to promote reliable engagement of the fluke point in firm or hard clay mooring bed soil. The latter requirement constrains the position of the attachment point relative to the fluke for an anchor intended for operation in firm or hard clays.

Most offshore marine anchors require the fluke angle to be adjusted appropriately to suit a soft or a firm mooring bed soil before deployment. Accordingly, the anchors must be hauled on deck of an anchor handling vessel to enable this operation to be carried out. This entails expenditure of time offshore with a corresponding, possibly considerable, cost penalty depending on the extent of the marine resources awaiting anchor installation.

Patent EP 0802111 discloses an anchor including an adjustment mechanism whereby the fluke angle can be adjusted by remote control, after installation of the anchor in a mooring bed soil, by means of an auxiliary pulling line attached to the anchor in parallel with the anchor cable. Disadvantages of this anchor include: premature operation of the adjustment mechanism as a result of soil resistance forces inducing tension in the auxiliary pulling line; an inability to reverse remotely the operation of the adjustment mechanism; a requirement for decking the anchor to replace a breaking pin in the adjustment mechanism between deployments of the anchor; and an inability of the anchor to maintain an appropriate point angle necessary for reliable engagement with the surface of a mooring bed comprising firm or hard clay soils.

The objective of the present invention includes, inter alia, the provision of an anchor which is capable of remote adjustment of fluke angle after installation of the anchor in a mooring bed soil, and which avoids the above-noted disadvantages.

In the following: the term "axis" is to be construed as being unlimited in length; the term "load application point" is to be construed as the point of intersection of an axis of an anchor line connecting member (for example, a shackle pin) with the plane of symmetry of an anchor; and, where an attachment point comprises a pivotable joint, the term "attachment point" is to be construed as a point on the pivot axis at the centre of the pivotable joint.

According to the present invention, a marine anchor includes a plane of symmetry and comprises a fluke and a shank, said fluke and shank being pivotably connected together, said fluke including an aft edge and extending to a foremost point in a forward direction of said anchor, characterised in that said anchor is provided with remotely operable locking and unlocking means whereby said shank is pivotally lockable and subsequently unlockable.

Preferably, said shank is pivotably lockable and subsequently unlockable in a position wherein a load application point in said shank defines a minimum fluke angle of said anchor.

Preferably, said remotely operable locking and unlocking means comprises a pivotable four-bar linkage.

Preferably, said four-bar linkage includes at least one forward elongate member and at least one aft elongate member coupled together by a coupling member to form said shank, said coupling member including a first load application point and a second load application point and transfer means for accommodating an anchor line connecting member movably therebetween, each elongate member having an upper attachment point at one end and a lower attachment point at another end, and at least a portion of said fluke having corresponding forward and aft attachment points spaced apart for accommodating said lower attachment points of said elongate members, said coupling member having corresponding forward and aft attachment points spaced apart for accommodating said upper attachment points of said elongate members, said aft elongate member and said coupling member being rigid to enable said four-bar linkage to be locked pivotally when a force, acting in a direction away from said fluke along a line of action contained in a plane intersecting said fluke in the vicinity of said foremost point of said fluke, is applied by said anchor line connecting member at said first load application point, and to be unlocked pivotally when a force, acting in a direction away from said fluke, is applied subsequently at said second load application point, following moving said anchor line attachment member thereto.

Preferably, said attachment points of said forward and aft elongate members together with said corresponding attachment points of said fluke and of said coupling member respectively comprise upper forward, lower forward, upper aft and lower aft pivotable joints each including a pivot axis.

Preferably, said transfer means comprises a passageway adapted to receive said connecting member such that said connecting member may be displaced from one load application point to another by moving in said passageway.

Preferably, said passageway comprises a slot having a forward end and an aft end and containing a locus arranged parallel to a planar or curved surface therein, with a first load application point located on said locus adjacent said forward end and a second load application point located on said locus adjacent said aft end.

Preferably, the pivot axis of said upper forward pivotable joint and the pivot axis of said upper aft pivotable joint intersect said plane of symmetry at points separated by a distance therebetween such as to permit said elongate members and said rigid coupling member to be pivoted relative to each other to move the pivot axis of said upper aft pivotable joint into intersection with a straight line containing the points of intersection with said plane of symmetry of the pivot axes of said upper forward and said lower aft pivotable joints whereby said four-bar linkage becomes locked by compressive forces induced in said aft rigid elongate member and induced in said rigid coupling member when a force, acting in a direction away from said fluke along a line of action contained in a plane which intersects said fluke in the vicinity of said foremost point of said fluke, is applied by said connecting member at said first load application point.

Preferably, said pivotable joints have clearances therein which permit the pivot axis of said upper aft pivotable joint to move through and slightly beyond said straight line containing the points of intersection with said plane of symmetry of the pivot axes of said upper forward and said lower aft pivotable joints to provide stable locking of said four-bar linkage.

Preferably, said four-bar linkage is arranged such that pivoting is arrested by said aft rigid elongate member making direct or indirect contact with said forward elongate member.

Preferably, a tangent to said locus of said slot at said first load application point is inclined to a straight line containing said forward point of said fluke and said first load application point to form an aft-opening angle in the range of 60° to 95°, when said four-bar linkage is locked.

Preferably, said first load application point lies in or aft of a plane containing the axes of both of said upper and lower forward pivotable joints.

Preferably, a plane at right angles to said plane of symmetry, containing said foremost point of said fluke and said first load application point, passes forward of the axis of said upper forward pivotable joint.

Preferably, said four-bar linkage has separation distances between axes of said pivotable joints such that said first and second load application points respectively have first and second stable positions relative to said fluke when a force, acting in a direction away from said fluke, is applied respectively at said first and second load application points by said connecting member.

Preferably, said minimum fluke angle of said anchor is in the range of 26° to 32°.

Embodiments of the present invention will now be described by way of example with reference to the accompanying drawings wherein.

Figure 1:
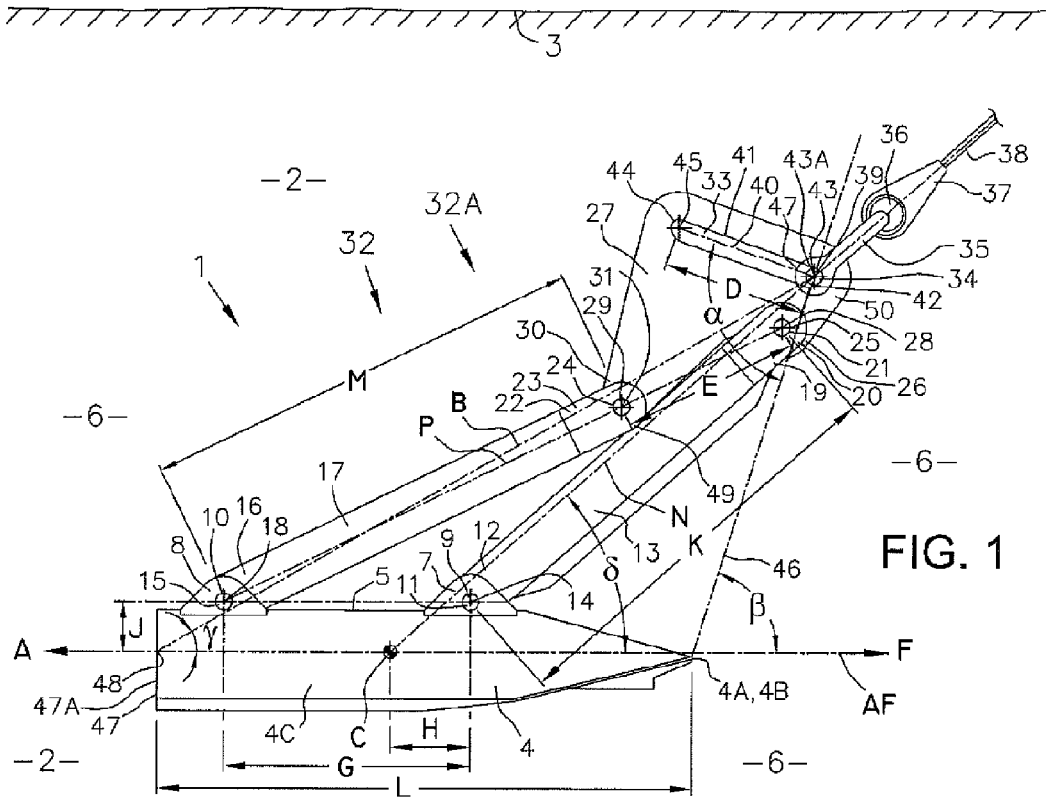
FIG. 1 shows a side view of a marine anchor according to the present invention.
Figure 2:
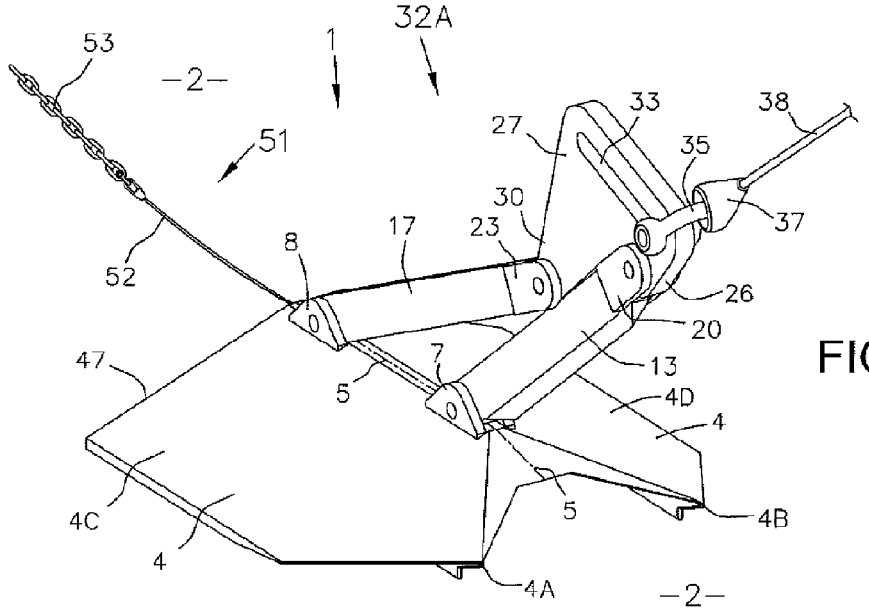
FIG. 2 shows an oblique view of the anchor of FIG. 1.

Referring to FIGS. 1 and 2, in an embodiment of the present invention, a marine anchor 1 for operation in a soil 2 below a mooring bed surface 3 (FIG. 1), includes fluke 4 which has foremost points 4A and 4B, and is formed by transversely inclined fluke halves 4C and 4D joined together at junction 5. Junction 5 is located in plane of symmetry 6 of anchor 1 and parallel to a forward-and-aft direction line AF of fluke 4 (FIGS. 1, 3, and 4) which defines forward direction F and aft direction A and is shown passing through fluke centroid C which is the centroid of the upper surfaces of fluke 4. Plane of symmetry 6 is represented by the planar sheet on which each of FIGS. 1, 3, 4, and 5 is drawn.

Forward clevis lug 7 and aft clevis lug 8 are upstandingly attached to fluke 4 at junction 5 and include pin holes 9 and 10 respectively. Pin 11 locates lower end 12 of rigid forward strut 13 pivotably about axis 14 of pin hole 9. Pin 15 locates lower end 16 of rigid aft strut 17 pivotably about axis 18 of pin hole 10. Upper end 19 of forward strut 13 comprises clevis lug 20 which includes pin hole 21. Upper end 22 of aft strut 17 comprises clevis lug 23 which includes pin hole 24. In forward strut 13, pin 25 locates forward lug 26 of rigid coupling plate 27 pivotably about axis 28 of pin hole 21. In aft strut 17, pin 29 locates aft lug 30 of coupling plate 27 pivotably about axis 31 of pin hole 24.

A four-bar linkage 32 is formed by fluke 4, shank struts 13 and 17, and coupling plate 27 with the latter three elements, or bars, rotatable relative to each other and relative to fluke 4, constituting shank 32A of anchor 1. Coupling plate 27 includes slot 33 provided to receive pin 34 of shackle 35. Shackle 35 is threaded through eye 36 of socket 37 attached to anchor line 38. Slot 33 has a width exceeding the diameter of pin 34 so that pin 34 can slide freely therein. Axis 39 of pin 34 traces out a locus 40 within slot 33 when pin 34 slides in contact with surface 41 therein distal from fluke 4.

When pin 34 is located in contact with a forward end 42 of slot 33, axis 39 contains first load application point 43 of anchor 1. When pin 34 is in contact with an aft end 44 of slot 33, axis 39 contains second load application point 45 of anchor 1. Distance D, separating first load application point 43 from second load application point 45, is in the range of 60 percent to 100 percent of distance E, separating axis 28 from axis 31. Distance E is in the range of 25 percent to 37 percent of the overall length L of fluke 4 measured in plane of symmetry 6 in forward direction F, with 32 percent preferred.

Slot 33 is arranged such that a tangent to locus 40 at first load application point 43 therein is inclined to a plane 46, containing foremost points 4A of fluke 4 and first load application point 43, to form an aft-opening angle $\alpha$ in the range of 60° to 95°, with 90° preferred. Plane 46 is at right angles to plane of symmetry 6 and is inclined to forward direction F to form a forwardly-opening point angle $\beta$ in the range of 60° to 72°, with 70° preferred. The separation between axis 28 and locus 40 is sufficient to allow eyes 47 of shackle 35 to pass clear of clevis lug 20 as pin 34 slides in slot 33. Preferably, first load application point 43 is located such that the separation distance between axis 28 and plane 46 is in the range of 1.5 and 2.5 times the diameter of pin 25.

Direction line AF intersects a plane 47A, containing rear edges 47 of fluke halves 4C and 4D, at point 48. A straight line B (FIG. 1) containing point 48 and first load application point 43 forms a forward-opening fluke angle $\gamma$ with forward direction F in the range of 26° to 32°, with 30° preferred, when first load application point 43 is located at a fixed position 43A relative to fluke 4. Fixed position 43A is the furthest forward location occupiable by first load application point 43 and is defined by the intersection of straight line B with plane 46. Thus, position 43A is fixed relative to fluke 4 by selecting angle $\beta$ and a minimum value for fluke angle $\gamma$. A straight line N (FIG. 1) containing centroid C and first load application point 43 forms a forward-opening fluke centroid angle $\delta$ in the range of 36° to 44°, with 41° preferred, when first load application point 43 occupies fixed position 43A.

The distance G, between axis 14 of pin hole 9 in forward clevis lug 7 and axis 18 of pin hole 10 in aft clevis lug 8, is in the range of 40 percent to 60 percent of length L. The distance H, between axis 14 and centroid C measured parallel to direction line AF is in the range of 10 percent to 20 percent of length L, with 15 percent preferred. Axes 14 and 18 each lie at right angles to and intersect a straight line parallel to direction line AF which is separated from centroid C by a distance J in the range of 7 percent to 11 percent of length L, with 9 percent preferred.

Distance K, separating axes 14 and 28 in forward shank strut 13, is in the range of 75 percent to 80 percent of length L, with 77 percent preferred. Distance M, separating axes 18 and 31 in aft shank strut 17, is in the range of 75 percent to 80 percent of length L, with 78 percent preferred. Distances E, G, K, and M are additionally arranged such that axis 31 is movable to and, preferably, beyond a straight line P (FIG. 1) containing axes 18 and 28 to bring strut 17 directly in contact with strut 13 or indirectly in contact with strut 13 via lug 30 of coupling plate 27 at contact point 49. The extent that axis 31 is movable beyond straight line P is mediated by the selection of an appropriate amount of clearance necessary between pin and pin hole in each of the pivotable joints of the four-bar linkage 32. When a pulling force in planes 6 and 46 (FIG. 1) is applied at first load application point 43 via shackle 35, socket 37, and anchor line 38, this arrangement of distances induces compressive forces in strut 17 and in coupling plate 27 between pin 25 and pin 29, and tensile force in strut 13 and in coupling plate 27 between pin 25 and shackle pin 34, and also induces a transverse reaction force between strut 13 and strut 17 at direct or indirect contact point 49. The transverse reaction force acts in opposition to transverse components of the compression forces induced in struts 13 and 17. These transverse components of the compression forces hold the four-bar linkage 32 in a locked mode which keeps first load application point 43 at fixed position 43A relative to fluke 4 while the direction of pulling force applied by anchor line 38 to shackle 35 is maintained substantially in planes 6 and 46 and thus directed away from points 4A of fluke 4.

Figure 5:
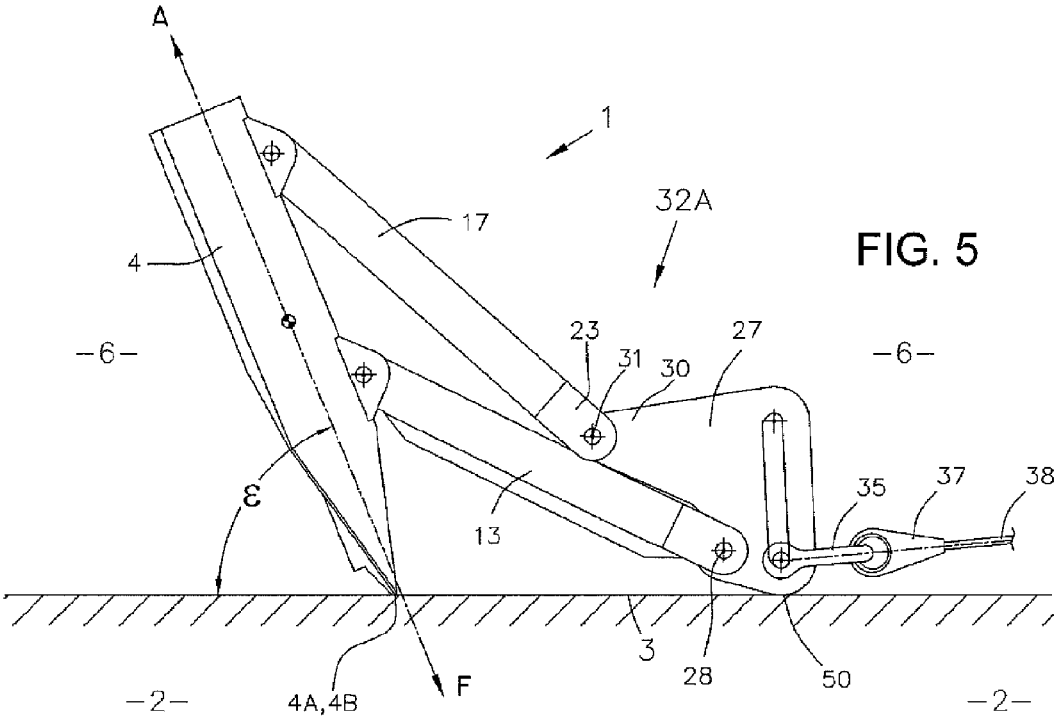
FIG. 5 shows a side view of the anchor of FIG. 1 tilted for penetration into a firm or hard clay mooring bed surface.

The configuration of the locked mode (FIGS. 1 & 5) occurs automatically when anchor 1 is tipped forward on being dragged horizontally on a firm or hard clay mooring bed surface 3 to bring points 4A and 4B of fluke 4 and a forward edge 50 of coupling plate 27 into contact with surface 3 whereby forward direction F is inclined to surface 3 at an aft-opening angle $\epsilon$ (FIG. 5). Angle $\epsilon$ is less than point angle $\beta$, which is held locked in the range set out above, and so promotes reliable penetration of points 4A and 4B into a firm or hard mooring bed surface 3.

Figure 3:
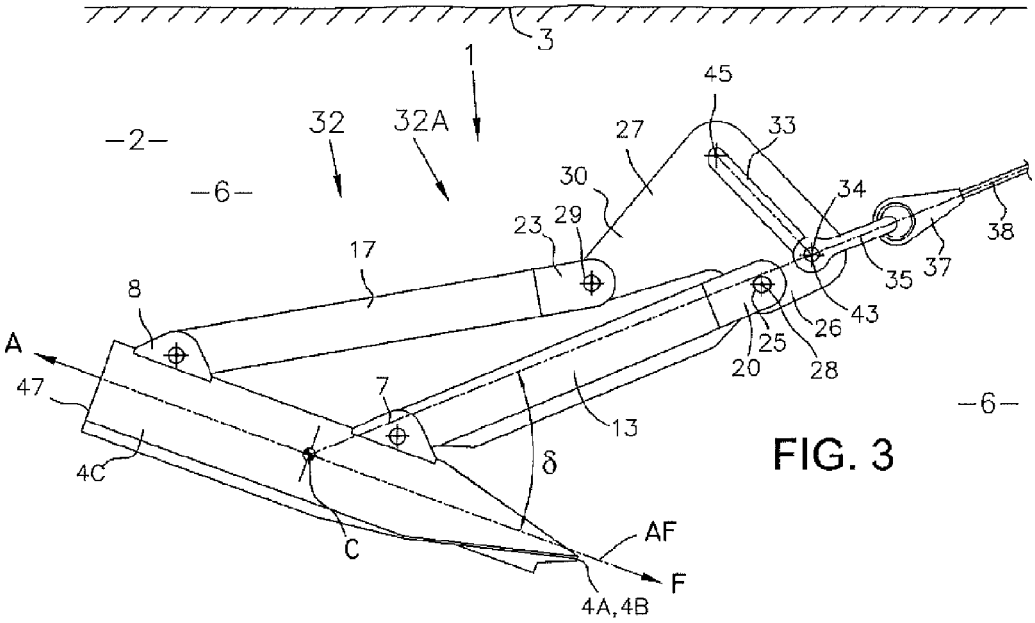
FIG. 3 shows a side view of the anchor of FIG. 1 with loading applied at a first load application point for operation in a firm or hard clay mooring bed soil.
Figure 4:
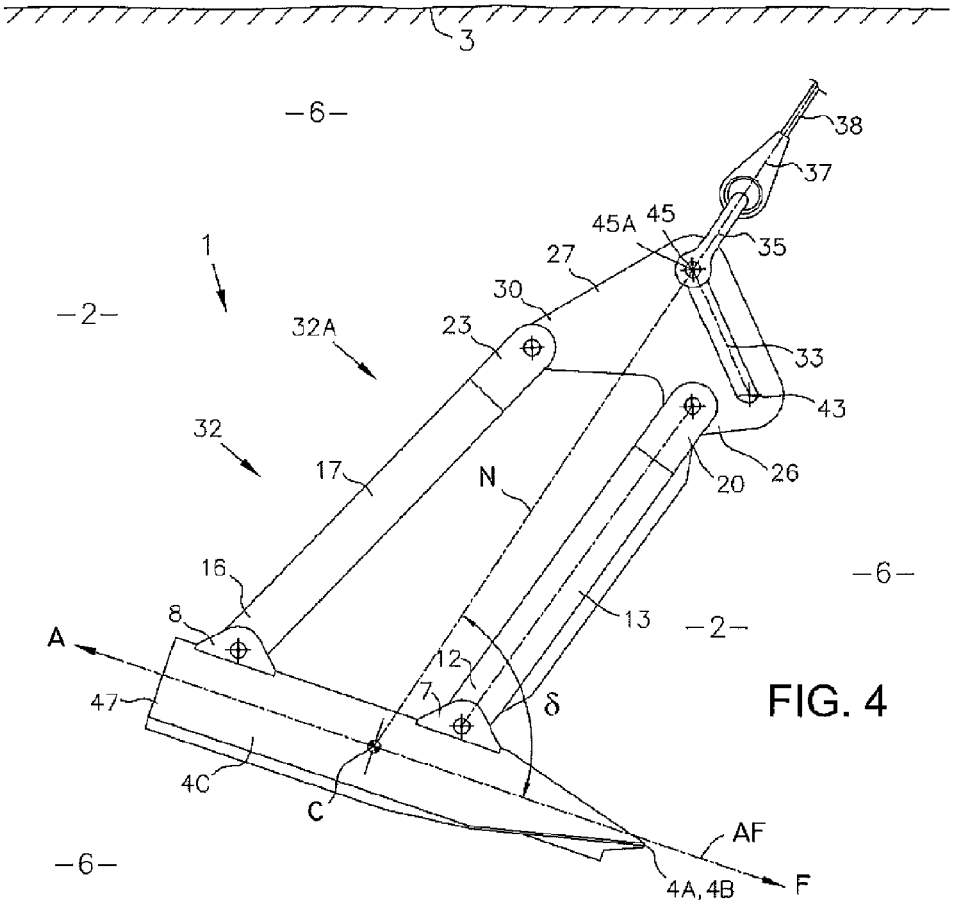
FIG. 4 shows a side view of the anchor of FIG. 1 with loading applied at a second load application point for operation in a soft clay mooring bed soil.

As anchor 1 penetrates through mooring bed surface 3, pressure of soil 2 on strut 17 causes strut 17 to rotate slightly to bring axis 31 above straight line P, thus bringing the four-bar linkage 32 out of locked mode (FIG. 3) whereby tensile force is now present in strut 17 and in strut 13 as well as in coupling plate 27 between pins 25 and 29 and between pin 25 and shackle pin 34. Rotation of strut 17 also causes coupling plate 27 to rotate to produce a compensatory opposing rotation of first load application point 43 about axis 28 which maintains first load application point 43 substantially in stable position 43A and so holds forward-opening fluke angle $\gamma$ (FIG. 1) at the before-mentioned selected angle in the range of 26° to 32° whereby anchor 1 is capable of embedding further in firm or hard clay soil as tension in anchor line 38 increases (FIG. 3). As embedment becomes progressively deeper below mooring bed surface 3, the ultimate holding capacity of anchor 1 in firm or hard soil is reached when fluke centroid C is moving substantially horizontally at a depth in the range of 1 to 1.5 times length L (FIG. 1) below mooring bed surface 3.

When the mooring bed soil consists of soft clay, anchor 1 penetrates deeper below mooring bed surface 3 where the ultimate holding capacity of anchor 1 is reached when fluke centroid C is moving substantially horizontally at a depth in the range of 2 to 3 times length L below surface 3. However, the ultimate holding capacity at this depth is undesirably low in step with the weaker strength of the soil. This is corrected by hauling up on anchor line 38 to cause shackle 35 to slide along slot 33 in coupling plate 27 to bring pin 34 of shackle 35 into contact with end 44 of slot 33 and axis 39 of pin 34 into alignment with second load application point 45 as four-bar linkage 32 rotates such that fluke angle $\gamma$ (FIG. 1) is increased to about 56° and second load application point 45 occupies a stable position 45A which lies on a straight line, containing fluke centroid C, forming a forward-opening fluke centroid angle $\delta$ (FIG. 4) with forward direction F in the range of 72° to 78°, with 75° preferred. Second load application point 45 remains substantially at stable position 45A as embedment becomes progressively deeper in the soft clay below mooring bed surface 3 until the ultimate holding capacity of anchor 1 is reached when fluke centroid C is moving substantially horizontally at a depth of between 10 to 12 times length L below surface 3, where the strength of a soft clay soil is usually high enough to provide holding capacity comparable to that obtainable in mooring beds of firm or hard clay.

In use, drag embedment installation of an anchor according to the present invention as shown in FIGS. 1 to 4, is facilitated by attaching a drogue tail 51 to fluke 4 at rear edge 47 (FIG. 2) in plane of symmetry 6 (FIG. 1). Drogue tail 51 comprises a length of wire rope 52 connected to a short length of chain 53. Anchor 1 is lowered from an installation vessel towards mooring bed surface 3 by paying out anchor line 38 at a paying out speed of about one knot while the installation vessel is moving slowly forward also at a speed of about one knot. Chain 53 of drogue tail 51 engages on mooring bed surface 3 first and drags thereover as anchor 1 approaches surface 3. Resistance force developed from dragging chain 53 on surface 3 pulls anchor line 38 out of vertical to cause anchor 1 to turn, by a pendulum effect, to bring forward direction F of fluke 4 into the heading direction of the moving installation vessel as anchor 1 touches down onto mooring bed surface 3. Due to vessel forward speed being equal to anchor line pay-out speed, anchor 1 comes to rest upright with fluke 4 lying substantially horizontal on mooring bed surface 3. Vessel speed and anchor line pay-out speed are maintained until a desired scope of anchor line 38 has been paid out. The vessel is now halted and anchor line paying out ceased to permit the anchor line to be stoppered off prior to commencing drag embedment of anchor 1 by bollard pull.

When soil 2 below mooring bed surface 3 consists of firm or hard clay, as tension is applied to anchor 1 by anchor line 38 being pulled substantially horizontally at first load application point 43, anchor 1 tilts forward to bring points 4A and 4B of fluke 4 and edge 50 of coupling plate 27 into contact with mooring bed surface 3 whereby forward direction F is inclined to surface 3 at an aft-opening angle $\epsilon$ (FIG. 5). Angle $\epsilon$ is less than point angle $\beta$ and so promotes penetration of points 4A and 4B into surface 3. During tilting, the combined masses of strut 17 and coupling plate 27 automatically bring strut 17 directly into contact with strut 13, or indirectly into contact with strut 13 via lug 30 of coupling plate 27, at contact point 49 on strut 13. A tensile force starts building up in anchor line 38 in a direction contained in plane 46 (FIG. 1) as points 4A and 4B of fluke 4 commence penetrating through mooring bed surface 3. The moment of the tensile force about axis 28 of strut 13 holds lug 23 directly in contact with strut 13, or indirectly in contact with strut 13 via lug 30, with axis 31 having moved to and beyond line P containing axes 18 and 28 (FIG. 1). Simultaneously, the moment of the tensile force about axis 14 acts to lock strut 17 directly or indirectly against strut 13 to hold first load application point 43 at fixed position 43A relative to fluke 4 so that the inclination of fluke 4 to mooring bed surface 3, effectively limited to 180° minus $\beta$, does not become high enough to cause localised shear failure of mooring bed soil 2 adjacent foremost points 4A and 4B of fluke 4 and so avoids an undesirable result wherein fluke 4 backs out of soil 2 and drags without subsequent engagement with mooring bed surface 3. Anchor 1 thus engages reliably with mooring bed surface 3 and commences penetrating there-through.

The locked mode of four-bar linkage 32 persists as penetration progresses until the intersection point on fluke 4 of the line of action of tensile force in anchor line 38, acting at first load application point 43, moves in an aft direction substantially away from foremost points 4A and 4B of fluke 4. As the line of action approaches axis 14 of strut 13, with about two thirds of fluke 4 having penetrated below mooring bed surface 3, the moments of tensile force in anchor line 38 about axes 14 and 28 become changed sufficiently to cease locking strut 17 against strut 13 (FIG. 3). This allows strut 17 to rotate slightly away from strut 13 and so rotates coupling plate 27. However, as mentioned previously, rotation of coupling plate 27 causes first load application point 43 to rotate about axis 28 such that first load application point 43 is held substantially in a fixed position relative to fluke 4 at position 43A and so maintains fluke angle γ at a minimum value suitable for the promotion of penetration in firm or hard clay soils below mooring bed surface 3.

With loading applied horizontally to anchor 1 at first load application point 43 in hard clay soils, tension in anchor line 38 increases rapidly and ultimate holding capacity in excess of the breaking load of anchor line 38 may be reached before fluke 4 has penetrated wholly below mooring bed surface 3.

In firm clay (or sand) soil, with loading applied horizontally to anchor 1 at first load application point 43, pulling on anchor line 38 causes tension therein to increase rapidly as anchor 1 penetrates wholly below mooring bed surface 3 along a shallow curved trajectory, traced out by centroid C of fluke 4, which finally becomes horizontal, as the ultimate holding capacity of anchor 1 is established. This occurs when centroid C of fluke 4 has penetrated to a depth below mooring bed surface 3 of between 1 and 1.5 times length L, after anchor 1 has been dragged horizontally some 4 to 7 times length L.

In soft clay soils, with loading applied at first load application point 43, a similar shallow curved trajectory is traced out by centroid C, with fluke 4 becoming substantially horizontal for a penetration depth of centroid C of some 1.5 to 3 times length L, after anchor 1 has been dragged horizontally some 10 to 20 times length L. In this case, tension in anchor line 38 increases slowly and the ultimate holding capacity is greatly reduced due to the weaker nature of the soft clay soil.

When a low rate of increase of tension in anchor line 38 is observed during installation, indicating the presence of soft clay soil, the installation vessel ceases pulling and reverses back over anchor 1 while shortening scope of anchor line 38. Anchor line 38 is then heaved up to cause pin 34 of shackle 35 to slide aft and upwards on surface 41 in slot 33 of coupling plate 27 along inclined locus 40 (FIG. 1) to bring pin 34 into contact with end 44 of slot 33 whereby axis 39 of pin 34 is relocated to second load application point 45 whereupon struts 13 and 17 and coupling plate 27 of four-bar linkage 32 rotate to move second load application point 45 to a position on straight line N (FIG. 4) which contains centroid C of fluke 4 and is inclined to direction F at angle δ. Completion of this movement is signalled at the installation vessel by a sudden increase of tension in anchor line 38 due to the high inclination of fluke 4 to the direction of tension applied at second load application point 45. Anchor line 38 is then paid out to a scope suitable for further embedment of anchor 1 in soft clay. For installation in very deep water, this scope would give rise to a typical uplift angle of inclination of anchor line 38 to horizontal at mooring bed surface 3 of between 15° and 20°.

Further pulling applies loading on anchor 1 via shackle 35 with axis 39 of pin 34 at second load application point 45 now located substantially at stable position 45A with respect to fluke 4 (FIG. 4) such that fluke angle γ (FIG. 1) has increased to about 56° and fluke centroid angle δ (FIG. 4) has increased to about 75°. With these increased angles, anchor 1 is enabled for much deeper embedment in soft clay soil. Further pulling causes fluke 4 to rotate to incline direction F well below horizontal whereby anchor 1 moves substantially in direction F and centroid C moves along a new steeply inclined trajectory which tends to become horizontal when anchor 1 has been dragged some 20 times length L and centroid C has penetrated over 12 times length L to provide an ultimate holding capacity similar to that obtainable in firm clay soil.

Recovery of anchor 1, by an anchor recovery vessel, is achieved for all consistencies of mooring bed soils by pulling anchor line 38 upwards and backwards over and beyond the embedded position of anchor 1 until an uplift angle between anchor line 38 and horizontal at mooring bed surface 3 is about 70°.

If fluke 4 is only partially embedded in hard soil with anchor line 38 horizontal at anchor 1, such upwards and backward loading causes pin 34 of shackle 35 to move in slot 33 of coupling plate 27 from first load application point 43 to engage at second load application point 45. Loading at second load application point 45 initially produces a moment about pin 25 in clevis lug 20 which rotates coupling plate 27 and aft strut 17 out of engagement with forward strut 13, thus unlocking four-bar linkage 32. Further loading then rotates four-bar linkage 32 to carry second load application point 45 past stable position 45A until stopped by lug 26 of coupling plate 27 making contact with strut 13 inside clevis lug 20. Yet further loading rotates anchor 1 backwards to incline fluke 4 upwards at 30° to 40° to horizontal and brings the line of force applied at second load application point 45 into a direction substantially at right angles to forward direction F with the consequence that tension in anchor line 38 is observed to increase rapidly. Pulling is then stopped and the recovery vessel moves forward while paying out anchor line 38 until an uplift angle between anchor line 38 and horizontal at mooring bed surface 3 is about 70°. Anchor line 38 is then stoppered off and bollard pull is applied to re-tension anchor line 38. This causes pin 34 of shackle 35 to slide forward in slot 33 to relocate axis 39 at first load application point 43. Four-bar linkage 32 now closes to bring lug 23 of strut 17 close to, but not in contact with, strut 13 whereby first load application point 43 is located substantially at position 43A and fluke angle γ is restored to minimum value. Heaving in anchor line 38 at 70° uplift angle, as the recovery vessel moves forward, now causes anchor 1, with fluke angle γ at minimum value, to move forwards and upwards, at relatively low tension in anchor line 38, to mooring bed surface 3 where anchor 1 is broken out of the mooring bed and heaved up for decking on the recovery vessel.

If fluke 4 is deeply embedded in soft soil, the recovery procedure is as previously described except that, since second load application point 45 is already located at stable position 45A (FIG. 4), unlocking of four-bar linkage 32 and initial rotation to bring second load application point 45 into coincidence with stable position 45A has already occurred.

If desired, anchor 1 may be moved to a new location on the seabed without heaving up for decking on the recovery vessel. Anchor 1 is then redeployed from a pendent position above and near seabed surface 3 using the same procedure as described previously which results in the configuration of the locked mode of anchor 1 being re-established as anchor 1 is re-laid on seabed surface 3. Re-locking of four-bar linkage 32 then occurs as anchor 1 is tilted into engagement with seabed 2 by pulling on anchor line 38.

In a minor modification of anchor 1, re-locking can be realized prior to breaking anchor 1 out of seabed 2 by extending slot 33 in coupling plate 27 to locate first load application point 43 slightly further forward and so provide a larger separation of plane 46 from axis 28 in strut 13 (FIG. 1) to increase the moment about axis 28 of the tensile force in anchor line 38 sufficiently to overcome the previously mentioned unlocking effect of soil pressure on strut 17.

Thus, as described, manipulation of anchor line 38 enables four-bar linkage 32 of anchor 1 to be locked remotely, to provide a small fluke angle γ for reliable seabed surface penetration in hard seabeds, and subsequently to be unlocked remotely. Manipulation of anchor line 38 also enables four-bar linkage to be rotated remotely to provide selectably a small fluke angle in anchor 1 suitable for shallow penetration in hard seabed conditions or a larger fluke angle suitable for deep penetration in soft seabed conditions. In short, anchor 1 is enabled for remote cyclic locking and unlocking of four-bar linkage 32 and remote selection of fluke angle γ.

Anchor 1 has advantages over the before-mentioned prior art anchor which include at least one of the following: remote fluke angle increase and decrease capability in situ achievable by anchor line manipulation; remotely reversible locking to hold a load application point on the shank at a fixed position relative to the fluke to provide a fluke angle and point angle suitable for reliable penetration in firm or hard mooring bed soils; no necessity for hauling on deck to change fluke angle to suit soft or firm soil conditions; freedom from premature operation of a fluke angle adjustment mechanism; and no necessity for replacement of a breaking pin in a fluke angle adjustment mechanism.

Figure 6:
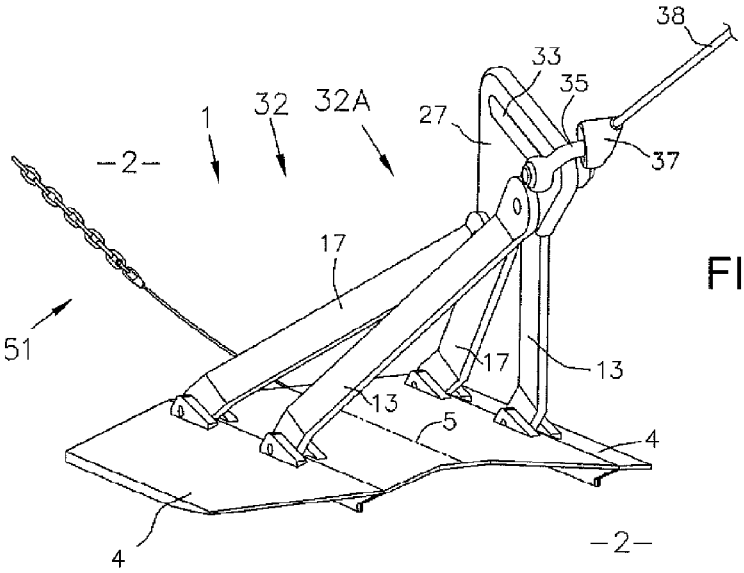
FIG. 6 shows an oblique view of a modification of the anchor of FIG. 1.

Modifications of the anchor herein described are, of course, possible within the scope of the present invention. For example, strut 13 may be substituted by a flexible forward elongate member 13, such as a rope or chain, carrying tensile force only, in which case, rigid strut 17 would make direct or indirect contact with elongate member 13 at athwartly-spaced contact points 49 whereby a small deflection of flexible forward elongate member 13 when taut would provide a significant transverse reaction force on strut 17 so holding anchor 1 in locked mode for reliable engagement with a firm or hard clay mooring bed surface 3. Further, slot 33 in coupling plate 27 may be curved. Also, four-bar linkage 32 may comprise two rigid aft elongate members 17 together with one flexible or rigid forward elongate member 13 or together with a pair of flexible or rigid forward elongate members 13. By way of example, FIG. 6 shows an oblique view of anchor 1 wherein four-bar linkage 32 includes two rigid aft elongate members 17 and two rigid forward elongate members 13 with each set of aft or forward elongate members having fluke attachment points on fluke 4 spaced athwart plane of symmetry 6 and straddling junction 5. It is also envisaged that such modifications can encompass indirect contact between aft struts 17 and forward elongate members 13 being effected via a member other than coupling plate 27 and encompass pin 34 of shackle 35 having a sleeve thereon with flat faces arranged to reduce contact pressure between pin 34 and surface 41 of coupling plate 27.

The invention claimed is:

1. A marine anchor with a plane of symmetry, comprising:

a fluke including an aft edge and extending to a foremost point in a forward direction of the anchor;

a shank pivotably connected to the fluke, the shank including a load application point defining a fluke angle of the anchor when in operation, the load application point provided for attachment of an anchor line thereto, the shank pivotably, remotely locked and unlocked relative to the fluke to permit remote adjustment of the fluke angle by pivoting of the shank when the anchor is embedded in a soil, the remote locking and unlocking and pivoting of the shank being effected by manipulation of the anchor line such that the shank is sequentially and cyclically:

pivotably lockable against increase of an initial fluke angle of the anchor;

pivotably unlockable to permit pivoting to establish a larger fluke angle; and pivotable to re-establish the initial fluke angle and re-locked thereat.

2. The marine anchor of claim 1, wherein the shank comprises:

at least one forward elongate member; and at least one aft elongate member coupled to the forward elongate member by a coupling member, the coupling member comprising:

a first load application point;

a second load application point; and transfer means for accommodating an anchor line connecting member movable therebetween, each forward and aft elongate member comprising:

an upper attachment point at an upper end; and a lower attachment location at a lower end, at least a portion of the fluke attached to corresponding forward and aft attachment locations spaced apart for accommodating the lower attachment locations of the elongate members, the coupling member having corresponding forward and aft attachment locations spaced apart for accommodating the upper attachment points of the forward and aft elongate members, the aft elongate member and the coupling member being rigid to enable the shank to be locked pivotably when a force, acting in a direction away from the fluke along a line of action contained in a plane intersecting the fluke in the vicinity of the foremost point of the fluke, is applied by the anchor line connecting member at the first load application point, and to be unlocked pivotally when a force, acting in a direction away from the fluke, is applied subsequently at the second load application point.

3. The marine anchor of claim 2, wherein the attachment points and the attachment locations of the forward and aft elongate members together with the corresponding attachment locations of the fluke and of the coupling member respectively comprise upper forward, lower forward, upper aft and lower aft pivotable joints each including a pivot axis.

4. The marine anchor of claim 3, wherein the first load application point lies in, or aft of, a plane containing the pivot axes of both of the upper and lower forward pivotable joints.

5. The marine anchor of claim 3, wherein a plane at right angles to the plane of symmetry, containing the foremost point of the fluke and the first load application point, passes forward of the pivot axis of the upper forward pivotable joint.

6. The marine anchor of claim 3, wherein the pivot axis of the upper forward pivotable joint and the pivot axis of the upper aft pivotable joint intersect the plane of symmetry at points separated by a distance therebetween such as to permit the elongate members and the rigid coupling member to be pivoted relative to each other to move the pivot axis of the upper aft pivotable joint into intersection with a straight line containing the points of intersection with the plane of symmetry of the pivot axis of the upper forward pivotable joint and of the pivot axis of the lower aft pivotable joint whereby the shank becomes locked by compressive forces induced in the rigid aft elongate member and induced in the rigid coupling member when a force, acting in a direction away from the fluke along a line of action contained in a plane which intersects the fluke in the vicinity of the foremost point of the fluke, is applied by the connecting member at the first load application point.

7. A marine anchor with a plane of symmetry, comprising:

a fluke including an aft edge and extending to a foremost point in a forward direction of the anchor;

a shank pivotably connected to the fluke, the shank including a load application point defining a fluke angle of the anchor when in operation, the load application point provided for attachment of an anchor line thereto, the shank pivotably, remotely locked and unlocked relative to the fluke to permit remote adjustment of the fluke angle by pivoting of the shank when the anchor is embedded in a soil, the shank pivotably, remotely locked and unlocked with a pivotable four-bar linkage formed by four bar members connected in a loop by four ioints and including at least three rigid bar member, the remote locking and unlocking and pivoting of the shank being effected by manipulation of the anchor line.

8. The marine anchor of claim 7, wherein the shank is pivotably lockable and subsequently unlockable in a position wherein a load application point in the shank defines a minimum fluke angle of the anchor in the range of approximately 26° to 32°.

9. The marine anchor of claim 7, wherein the shank comprises:

at least one forward elongate member; and at least one aft elongate member coupled to the forward elongate member by a coupling member, the coupling member comprising:

a first load application point;

a second load application point; and transfer means for accommodating an anchor line connecting member movable therebetween, each forward and aft elongate member comprising:

an upper attachment point at an upper end; and a lower attachment location at a lower end, at least a portion of the fluke attached to corresponding forward and aft attachment locations spaced apart for accommodating the lower attachment locations of the elongate members, the coupling member having corresponding forward and aft attachment locations spaced apart for accommodating the upper attachment points of the forward and aft elongate members, the aft elongate member and the coupling member being rigid to enable the four-bar linkage to be locked pivotally when a force, acting in a direction away from the fluke along a line of action contained in a plane intersecting the fluke in the vicinity of the foremost point of the fluke, is applied by the anchor line connecting member at the first load application point, and to be unlocked pivotally when a force, acting in a direction away from the fluke, is applied subsequently at the second load application point.

10. The marine anchor of claim 9, wherein the attachment points and the attachment locations of the forward and aft elongate members together with the corresponding attachment locations of the fluke and of the coupling member respectively comprise upper forward, lower forward, upper aft and lower aft pivotable joints each including a pivot axis.

11. The marine anchor of claim 10, wherein the first load application point lies in, or aft of, a plane containing the pivot axes of both of the upper and lower forward pivotable joints.

12. The marine anchor of claim 10, wherein a plane at right angles to the plane of symmetry, containing the foremost point of the fluke and the first load application point, passes forward of the pivot axis of the upper forward pivotable joint.

13. The marine anchor of claim 10, wherein the four-bar linkage comprises separation distances between pivot axes of the pivotable joints such that the first and second load application points respectively have first and second stable positions relative to the fluke when a force, acting in a direction away from the fluke, is applied respectively at the first and second load application points by the connecting member.

14. The marine anchor of claim 10, wherein the pivot axis of the upper forward pivotable joint and the pivot axis of the upper aft pivotable joint intersect the plane of symmetry at points separated by a distance therebetween such as to permit the elongate members and the rigid coupling member to be pivoted relative to each other to move the pivot axis of the upper aft pivotable joint into intersection with a straight line containing the points of intersection with the plane of symmetry of the pivot axis of the upper forward pivotable joint and of the pivot axis of the lower aft pivotable joint whereby the four-bar linkage becomes locked by compressive forces induced in the rigid aft elongate member and induced in the rigid coupling member when a force, acting in a direction away from the fluke along a line of action contained in a plane which intersects the fluke in the vicinity of the foremost point of the fluke, is applied by the connecting member at the first load application point.

15. The marine anchor of claim 9, wherein the transfer means comprises a passageway adapted to receive the connecting member such that the connecting member may be displaced from one load application point to another by moving in the passageway.

16. The marine anchor of claim 15, wherein the passageway comprises a slot having a forward end and an aft end and containing a locus arranged parallel to a planar or curved surface therein, with a first load application point located on the locus adjacent the forward end and a second load application point located on the locus adjacent the aft end.

17. The marine anchor of claim 14, wherein the pivotable joints comprise clearances which permit the pivot axis of the upper aft pivotable joint to move through and slightly beyond the straight line containing the points of intersection with the plane of symmetry of the pivot axis of the upper forward pivotable joint and of the pivot axis of the lower aft pivotable joint to provide stable locking of the four-bar linkage.

18. The marine anchor of claim 16, wherein a tangent to the locus of the slot at the first load application point is inclined to a straight line containing the forward point of the fluke and the first load application point to form an aft-opening angle in the range of approximately 60° to 95°, when the four-bar linkage is locked.

19. The marine anchor of claim 9, wherein the forward elongate member comprises a flexible member such as a rope or chain.

20. The marine anchor of claim 9, wherein the four-bar linkage is arranged such that pivoting is arrested by the rigid aft elongate member making direct or indirect contact with the forward elongate member.

* * * * *